US006173141B1

(12) United States Patent
Sakagami et al.

(10) Patent No.: US 6,173,141 B1
(45) Date of Patent: Jan. 9, 2001

(54) APPARATUS FOR FORMING COLOR IMAGES BY THE SUPERIMPOSITION OF VISUALIZED LATENT IMAGES HAVING DRIVE MEANS FOR SIMULTANEOUSLY DRIVING AT LEAST A RECORDING MEDIUM CONVEYING MEANS AND A SOURCE OF BLACK VISUALIZED LATENT IMAGES

(75) Inventors: Hidekazu Sakagami, Sakurai; Toshiro Kurishita, Nara; Masashi Hirai, Katano; Osamu Nakayama, Nara, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/105,674

(22) Filed: Jun. 26, 1998

(30) Foreign Application Priority Data

Jul. 19, 1997 (JP) ..... 9-175597

(51) Int. Cl.[7] ..... G03G 15/01
(52) U.S. Cl. ..... 399/167; 399/300
(58) Field of Search ..... 399/121, 298, 399/299, 300–303, 306, 308, 310–315, 75

(56) References Cited

U.S. PATENT DOCUMENTS 5,185,627 * 2/1993 Hartman ..... 399/75
5,313,259 * 5/1994 Smith ..... 399/299 X
5,365,324 * 11/1994 Gu et al. ..... 399/299
5,386,286 * 1/1995 Kinouchi et al. ..... 399/299 X
5,390,010 * 2/1995 Yamahata et al. ..... 399/308
5,740,493 * 4/1998 Otaki et al. ..... 399/299 X
5,765,082 * 6/1998 Numazu et al. ..... 399/299
5,787,323 * 7/1998 Nomura et al. ..... 399/111

FOREIGN PATENT DOCUMENTS 59-7615 * 1/1984 (JP) .
61-156161 7/1986 (JP) .
5-19641 1/1993 (JP) .
10-78708 * 3/1998 (JP) .

* cited by examiner

*Primary Examiner*—Quana Grainger
(74) *Attorney, Agent, or Firm*—Dike, Bronstein, Roberts & Cushman, LLP; David G. Conlin; David A. Tucker

(57) ABSTRACT

Photoreceptor drums for forming color images each have a gear as the drive transmission element at their central shafts. Each gear has an idle gear which in turn is coupled with a first motor via a timing belt. The photoreceptor drum for forming black monochrome images has a gear as the drive transmission element at its central shaft. This gear has an idle gear which is coupled with a second motor.

11 Claims, 6 Drawing Sheets

APPARATUS FOR FORMING COLOR IMAGES BY THE SUPERIMPOSITION OF VISUALIZED LATENT IMAGES HAVING DRIVE MEANS FOR SIMULTANEOUSLY DRIVING AT LEAST A RECORDING MEDIUM CONVEYING MEANS AND A SOURCE OF BLACK VISUALIZED LATENT IMAGES

BACKGROUND OF THE INVENTION (1) Field of the Invention

The present invention relates to a color image forming apparatus in which a final image is obtained by forming an image at the image forming station and transferring the formed image onto a print media being conveyed to the image forming station by print media conveying means. More specifically, the present invention is directed to an image forming apparatus of an electrophotographic type for forming color images such as a color copier, color printer etc.

(2) Description of the Prior Art

In recent years, color copiers have been developed to meet the demands for color recordings for office use.

One mechanism for such color copiers is of a tandem type, which comprises four photoreceptor drums arranged in parallel to each other, each drum being provided with a charger device, writing unit such as a LSU or the like, developing unit, transfer device, cleaning device arranged therearound. In this configuration, light reflected from a color original is separated into color components, each different color beam being supplied to a corresponding photoreceptor drum so that a corresponding latent image is formed thereon. The thus formed latent images on the photoreceptors are developed with toners of yellow, magenta, cyan and black, respectively, and the developed images are transferred in a superimposed manner onto printing paper which is supported on a transfer conveyor belt, thus producing a copy of the color image. When full color image forming is not needed, for example, in the case where a black monochrome image is formed, no toner image will be formed with the three photoreceptor drums of yellow, magenta and cyan and the black toner image is formed alone and then is transferred to the printing paper, thus producing a black monochrome image.

The method of driving the photoreceptor drums is disclosed in Japanese Patent Application Laid-Open Sho 61 No.156,161, in which all the photoreceptor drums are driven by a single driver source.

Development of color copiers of the tandem type provides a copy speed in the color copying copier, comparable to that in B/W monochrome copiers, but the price is still considerably high. When black monochrome copying is performed with a color copier of this type, the photoreceptor drums for colors which will not be used for the image forming, also are driven and hence worn out unnecessarily by the cleaning blades and the transfer conveyer belt. Further, when a black monochrome image is formed, the photoreceptor drums for colors also operate in contact with the transfer conveyer belt, which stains the belt with toner, causing degradation of image quality. Further, if the process speed is designed to be faster in order to enhance the speed of black monochrome copying, a large increase in the driving force is needed since the driver drives the photoreceptor drums for colors as well.

SUMMARY OF THE INVENTION

It is therefore an object of the present invention to provide a color image forming apparatus wherein the image support provided for forming black monochrome images only is operated without activating the image supports provided for forming color images so as to avoid the wear of the parts and degradation of the image quality and wherein black monochrome copying can be performed at a speed as fast as in conventional black monochrome copiers.

In order to achieve the above object, the present invention is configured as follows:

In accordance with the first aspect of the invention, a color image forming apparatus comprises:

a plurality of image supports;

driving means for rotationally driving each of the image supports;

latent image forming means for forming a latent image on each of the image supports;

developing means for visualizing the latent image formed on the each of the image supports; and transfer means for transferring the visualized image formed on each of the image supports to a recording medium to form a color image thereon, and is constructed such that the image supports include the first set of image supports on which color separated images are formed and the second image support on which a black monochrome image is formed; and the first set of image supports and the second image support are driven by individual driving means.

In accordance with the second aspect of the invention, a color image forming apparatus comprises:

a plurality of image supports;

driving means for rotationally driving each of the image supports;

latent image forming means for forming a latent image on each of the image supports;

developing means for visualizing the latent image formed on the each of the image supports;

transfer means for transferring the visualized images formed on the image supports onto a recording medium to form a color image thereon;

conveying means for conveying the recording medium to the transfer means; and discharging means for discharging the recording medium with an image transferred thereon, and is constructed such that the image supports include the first set of image supports on which color separated images are formed and the second image support on which a black monochrome image is formed; the first set of image supports and the second image support are driven by individual driving means; and the driving means for driving the second image support also drives the conveying means.

In accordance with the third aspect of the invention, the color image forming apparatus having the above second feature is characterized in that the transfer means temporarily transfers the visualized images formed on the image supports onto an intermediate transfer medium so as to produce a color image in a superimposed manner and then transfers the color image to the recording medium; and the driving means for driving the second image support also drives the intermediate transfer medium.

In accordance with the fourth aspect of the invention, the color image forming apparatus having the above second feature is characterized in that the driving means for driving the second image support also drives both the conveying means and the discharging means.

In accordance with the fifth aspect of the invention, the color image forming apparatus having the above second feature is characterized in that for forming a color image, the operation of the driving means of the first set of image supports and the operation of the driving means of the second image support are started and stopped simultaneously.

In accordance with the sixth aspect of the invention, the color image forming apparatus having the above first feature is characterized in that when only black monochrome images are formed, the first set of image supports is separated from the medium to which the image is transferred by the transfer means and only the driving means of the second image support is operated.

In accordance with the seventh aspect of the invention, the color image forming apparatus having the above first feature is characterized in that the driving means of the first set of image supports is operated at a first speed and the driving means of the second image support can be operated at the first speed and at a second speed, the first speed being lower than the second speed.

In accordance with the eighth and ninth aspects of the invention, the color image forming apparatus having the above first or second feature is characterized in that the driving means of the first set of image supports and the driving means of the second image support are operated with their periodical drive variations synchronized in phase with each other.

From the above configurations, the following effects can be obtained:

In accordance with the first aspect of the invention, the first set of image supports and the second image support are driven by individual driving means. Therefore, when a black monochrome image is formed, only the second image support is driven while the first set of image supports for forming color images will not be operated. In this way, the first set of image supports is not driven, so that no unnecessary wear will occur due to contact against cleaning blades or other elements.

In accordance with the second, third and fourth aspects of the invention, since the driving means of the second image support also serves as the driving means for conveying the recording medium, the driving means of the intermediate transfer medium or the discharging means for discharging the recording medium, it is not necessary to provide separate driving means and hence it is possible to simplify the drive control.

In accordance with the fifth aspect of the invention, since the operation of the driving means of the first set of image supports and the operation of the driving means of the second image support are started and stopped simultaneously, all the image supports will move with the same relative speed to the conveyer means which is driven by the driving means of the second image support, and hence will not be worn by friction.

In accordance with the sixth aspect of the invention, since the first set of image supports for forming color images is separated from the medium to which the image is transferred, it is possible to prevent the first set of image supports for forming color images from touching the recording medium and hence staining the recording medium surface with toner when only black monochrome images are formed.

In accordance with the seventh aspect of the invention, the driving means of the second image support can be driven at the first speed which is equal to the driving speed of the first sets of image supports and at the second speed which is greater than the first speed. Therefore it is possible to perform the copying operation of black monochrome images at a speed greater than that of the color image forming. In this way, it is possible even for the color image forming apparatus to achieve a copy speed comparable to that of dedicated type B/W monochrome copiers.

In accordance with the eighth and ninth aspects of the invention, since the driving means of the first set of image supports for forming color images and the driving means of the second image support for black monochrome images are operated with their periodical drive variations synchronized in phase with each other, it is possible to minimize the differential variation between the first set of image supports and the second image support. Accordingly, it is possible to minimize the mis-registration between the color images and the black monochrome image on the recording medium or on the intermediate transfer medium, thus making it possible to inhibit color binding blur.

DESCRIPTION OF THE PREFERRED EMBODIMENTS

The embodiment of the invention will be described with reference to FIG. 1.

Figure 1:
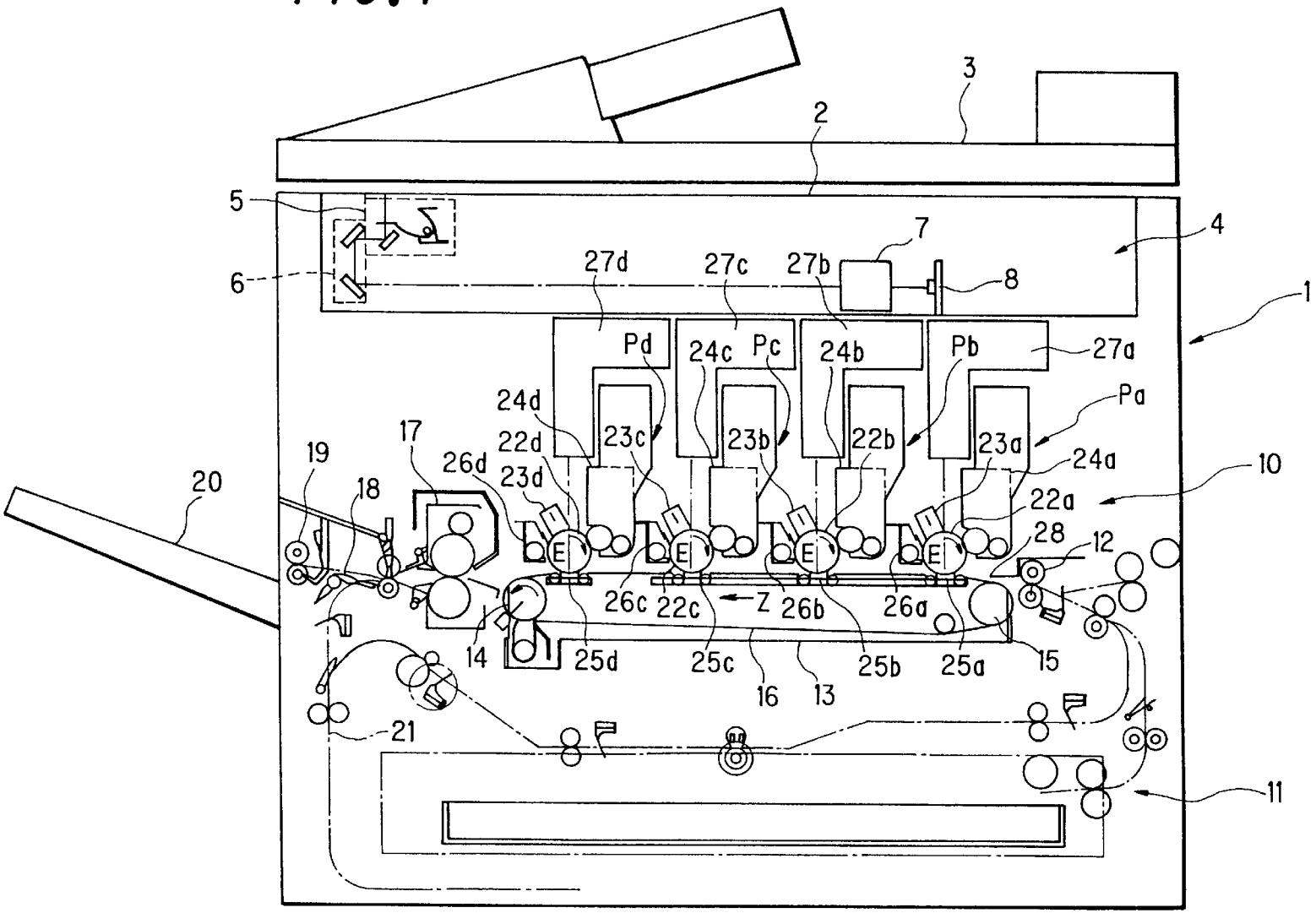
FIG. 1 is a schematic front sectional view showing the arrangement of a digital color copier.

FIG. 1 is a schematic front sectional view showing the arrangement of a digital color copier. Provided on the top of a copier body 1 are an original table 2 and a control panel while an automatic document feeder 3 is mounted on the top of original table 2. The document feeder is positioned with the predetermined relationship relative to the surface of original table 2 and supported so as to be opened and closed relative to original table 2. Further, copier body 1 incorporates an original scanner 4 as the image reading portion and an image forming portion 10.

First, automatic document feeder 3 is mounted over original table 2 on the top of copier body 1. This feeder is a reversing automatic document feeder 3 capable of handling double-sided originals. An original A is fed so that one side thereof opposes original table 2 at the predetermined position. After completion of reading the image on this side, original A is inverted and fed to original table 2 so that the other side opposes original table 2 at the predetermined position.

When the images on both sides of one original have been captured, this original is discharged and the duplex feeding operation of the next original will be effected. The operations of feeding original A and inverting the original are controlled in conformity with the operation of the whole copier. In order to capture the image of original A fed onto original table 2 by reversing automatic document feeder 3, original scanner 4 is provided so as to reciprocally move in parallel along the underside of original table 2.

This original scanner 4 comprises a first scanning unit 5, second scanning unit 6, optical lens 7 and photoelectric converting element 8. The first scanning unit 5 is composed of an exposure lamp for illuminating the original image surface and the first mirror which deflects the reflected light from the original in the predetermined direction. This scanning unit is located under the original table and moves back and forth at the predetermined scanning speed in parallel with and spaced from, the undersurface of the original table. The second scanning unit 6 is composed of the second and third mirrors which move back and forth in a parallel manner keeping a certain speed relationship relative to the first scanning unit 5. The light reflected on the original and deflected by the first mirror of the first scanning unit 5 is further deflected by this second scanning unit in the predetermined direction. Optical lens 7 focuses the light reflected off the original and deflected by the third mirror of the second scanning unit, on the predetermined position forming a reduced image in size. Color CCD 8 as the photoelectric converting element photo-electrically converts the image of light reduced and focused by optical lens 7 to produce an electric signal representing the reflected image of light from the original. The original image information thus converted into an electric signal by this color CCD 8 is then transferred to an image processor 31, to be described hereinbelow, where the signal is appropriately processed as image data.

Next, image forming portion 10 located in the lower side of copier body 1 will be described. Provided at the bottom of image forming portion 10 shown in FIG. 1 is a paper feeder mechanism 11, which separates sheets one by one from a stack of sheets accommodated in the sheet tray and feeds the sheet toward the recording station. The sheet thus separated and fed one by one is timing controlled and fed by a pair of resist rollers 12 located before image forming portion 10. For duplex printing, the sheet is re-fed and conveyed in synchronization with the operation of image forming portion 10.

Provided in the lower part of image forming portion 10 is a transfer conveyor belt mechanism 13 extending in a substantially parallel manner with the image forming portion. This transfer conveyor belt mechanism 13 is composed of a transfer conveyer belt 16 wound between a plurality of rollers such as a driving roller 14, driven roller 15 and the like so that the belt electrostatically attracts the paper thereto to convey it.

Provided on the downstream side of transfer conveyer belt mechanism 13 is a fixing unit 17 for fixing the toner image that has been transferred to the paper, onto the paper. The paper passes through the fixing roller nip of fixing unit 17 and further passes through a sheet path switching gate 18 and then discharged by a discharge roller 19 onto paper output tray 20 attached to the exterior wall of the machine.

Switching gate 18 is provided to select one of the two sheet paths, that is, one for discharging the sheet after fixing and the other for re-feeding the sheet to image forming portion 10. For duplex printing, the path of the sheet is switched by switching gate 18 so that the sheet is guided to the re-feeding path to image forming portion 10, and then is inverted upside down through a switch-back conveyance path 21 to be re-fed to image forming portion 10.

Arranged closely over the transfer conveyer belt 16 which is stretched in a substantially parallel manner between driving roller 14, driven roller 15 and the like, are the first, second, third and fourth image forming stations P*a*, P*b*, P*c* and P*d* arranged in parallel, in this order from the upstream side with respect to the sheet conveying direction. Transfer conveyor belt 16 is frictionally driven by the direction shown by arrow Z in FIG. 1 by means of driving roller 14, carrying the sheet as copy material which is fed by sheet feeder mechanism 11 as already explained. In this way, the sheet is successively conveyed through image forming stations P*a*, P*b*, P*c* and P*d*.

Image forming stations P*a*, P*b*, P*c* and P*d* have substantially the same configuration, and include photoreceptor drums 22*a*, 22*b*, 22*c* and 22*d*, respectively, each being rotated in the direction of arrow E in FIG. 1. Provided around photoreceptor drum 22*a*, 22*b*, 22*c* and 22*d*, are a charger 23*a*, 23*b*, 23*c* and 23*d* for uniformly charging the photoreceptor drum, a developing unit 24*a*, 24*b*, 24*c* and 24*d* for developing the static latent image formed on the photoreceptor drum, a transfer charger 25*a*, 25*b*, 25*c* and 25*d* for transferring the toner image thus developed to the sheet and a cleaning device 26*a*, 26*b*, 26*c* and 26*d* for removing the leftover toner from the photoreceptor drum. These components are arranged around the photoreceptor drum in the above-mentioned order with respect to the rotational direction of the photoreceptor drum.

Provided above photoreceptor drums 22*a*, 22*b*, 22*c* and 22*d* are laser beam scanner units 27*a*, 27*b*, 27*c* and 27*d*, respectively. Each laser beam scanner unit includes a semiconductor laser element emitting a spot beam of light being modulated with image data, a deflecting device for deflecting the laser beam from the semiconductor laser element in the main scan direction, and an f-θ lens for focusing the laser beam deflected by the deflector onto the photoreceptor surface.

Input to laser beam scanner 27*a* is the pixel signal corresponding to the yellow component image of a color original image; input to laser beam scanner 27*b* is the pixel signal corresponding to the magenta component image of a color original image; input to laser beam scanner 27*c* is the pixel signal corresponding to the cyan component image of a color original image; and input to laser beam scanner 27*d* is the pixel signal corresponding to the black component image of a color original image.

In this arrangement, a static latent image corresponding to the color-converted original image information is formed on the corresponding photoreceptor drum 22*a*, 22*b*, 22*c* and 22*d* in each recording unit. Each recording station holds a different color toner, that is, yellow toner in developing unit 24*a*, magenta toner in developing unit 24*b*, cyan toner in developing unit 24*c* and black toner in developing unit 24*d*, respectively. Accordingly, in each recording station, the color-converted original image information is reproduced as a toner image having each individual color.

A paper attraction (brush-like) charger 28 is provided between the first image forming station P*a* and sheet feeder mechanism 11. This paper attraction charger 28 charges the surface of transfer conveyer belt 16 so that the belt will be able to convey the paper as the copy paper, fed from paper feeder mechanism 11 from the first image forming station P*a* to the fourth image forming station P*d* whilst tightly attracting it thereon without causing any slippage or displacement.

A charge erasing device (not shown) is provided approximately above driving roller 14 between the fourth image station P*d* and fixing unit 17. This charge erasing device is applied with an alternating current so as to separate the sheet which is electrostatically attracted to conveyer belt 16.

In the thus configurated digital color copier, cut-sheet paper is used as the copy material. This copy sheet is delivered out from the paper cassette and fed into the guide to the sheet conveying path of paper feeder mechanism 11, then the leading part of the copy sheet is detected by the aforementioned sensor (not shown). Then the copy sheet is halted at resist roller paper 12 based on the detection signal output from the above sensor. Thereafter, the sheet is conveyed toward conveyor belt 16 running in the direction of arrow Z in FIG. 1, at a time synchronized with the operations of image forming stations P*a*, P*b*, P*c* and P*d*. During conveyance, the sheet will be conveyed stably passing through image forming stations P*a*, P*b* and P*c* and P*d* since conveyer belt 16 has been charged appropriately by paper attraction charger 28 mentioned above.

In each image forming station P*a*, P*b*, P*c* and P*d*, a toner image of a different color is formed by the aforementioned arrangement, and each toner image is superimposed over the support surface of the copy sheet being electrostatically attracted to and conveyed by conveyer belt 16. When the transfer of the image in the fourth image forming station P*d* has been completed, the copy sheet, specifically the leading edge of the paper, is separated from conveyer belt 16 with the help of the charge erasing charger, and is conveyed to fixing unit 17. Finally, the copy sheet with a toner image fixed thereon is discharged through the copy sheet output port to paper output tray 20.

Next, a driving means as the essential feature of the invention will be described with reference to FIG. 2.

Figure 2:
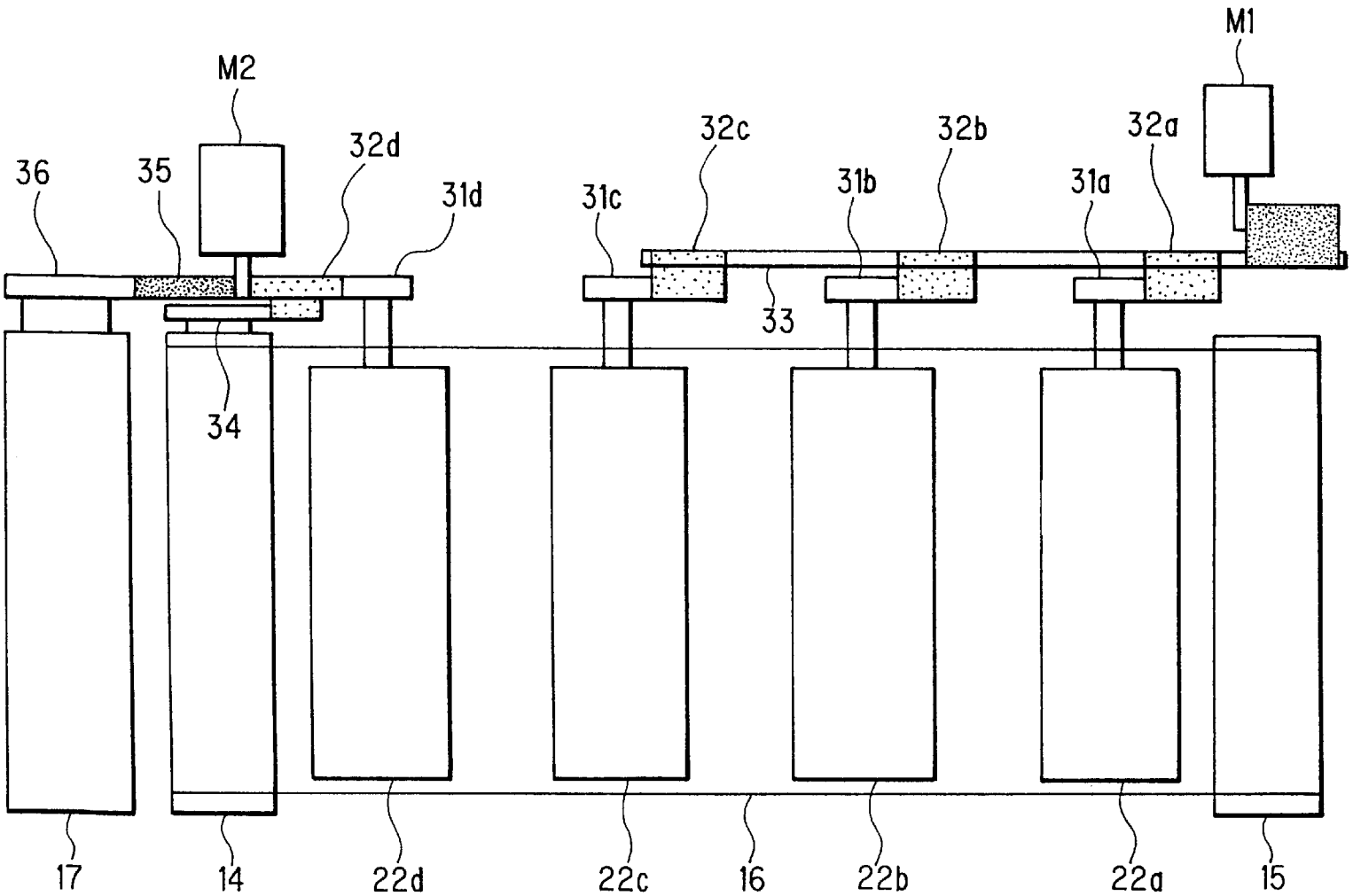
FIG. 2 is an illustrative diagram showing the drive linkage in the image forming portion.

FIG. 2 is an illustrative diagram showing the drive coupling in the image forming portion 10.

Photoreceptor drums 22*a*, 22*b* and 22*c* for forming color images have gears 31*a*, 31*b* and 31*c* as the transmission elements on their central shafts, respectively. The gears have an idle gear 32*a*, 32*b* and 32*c* respectively, which are in turn coupled with a motor M1 through a timing belt 33. Photoreceptor drum 22*d* for forming black images has a gear 31*d* as the transmission element on its central shaft. This gear is coupled with a motor M2 through an idle gear 32*d*.

In this driver configuration, photoreceptor drums 22*a*, 22*b* and 22*c* for color image forming and photoreceptor drum 22*d* for black image forming can be driven separately by means of motor M1 and motor M2. Thus, when only black images are formed, motor M2 alone may be driven. That is, photoreceptor drums 22*a*, 22*b* and 22*c* for color image forming will not be driven unnecessarily, so that it is possible to prevent the drums from being frictionally worn out by the cleaning blades.

Further, driving roller 14 of transfer conveyer belt 16 has a gear 34 as the drive transmission element, on the central shaft thereof. This gear 34 is coupled with motor M2 via idle gear 32*d*. Fixing unit 17 also has a gear 36 on the central shaft of the fixing roller, and this gear is coupled with motor M2 via idle gear 35.

The above drive configuration eliminates the necessity of providing a separate driver source for transfer conveyer belt 16 and fixing unit 17. In this configuration, motor M2 for driving photoreceptor drum 22*d* for black image forming is shared with the driving source of transfer conveyer belt 16 and fixing unit 17. Therefore,when only motor M2 is active during black monochrome image forming, transfer conveyer belt 16 and fixing unit 17 are also automatically active, so that the drive control can be simplified.

Figure 3:
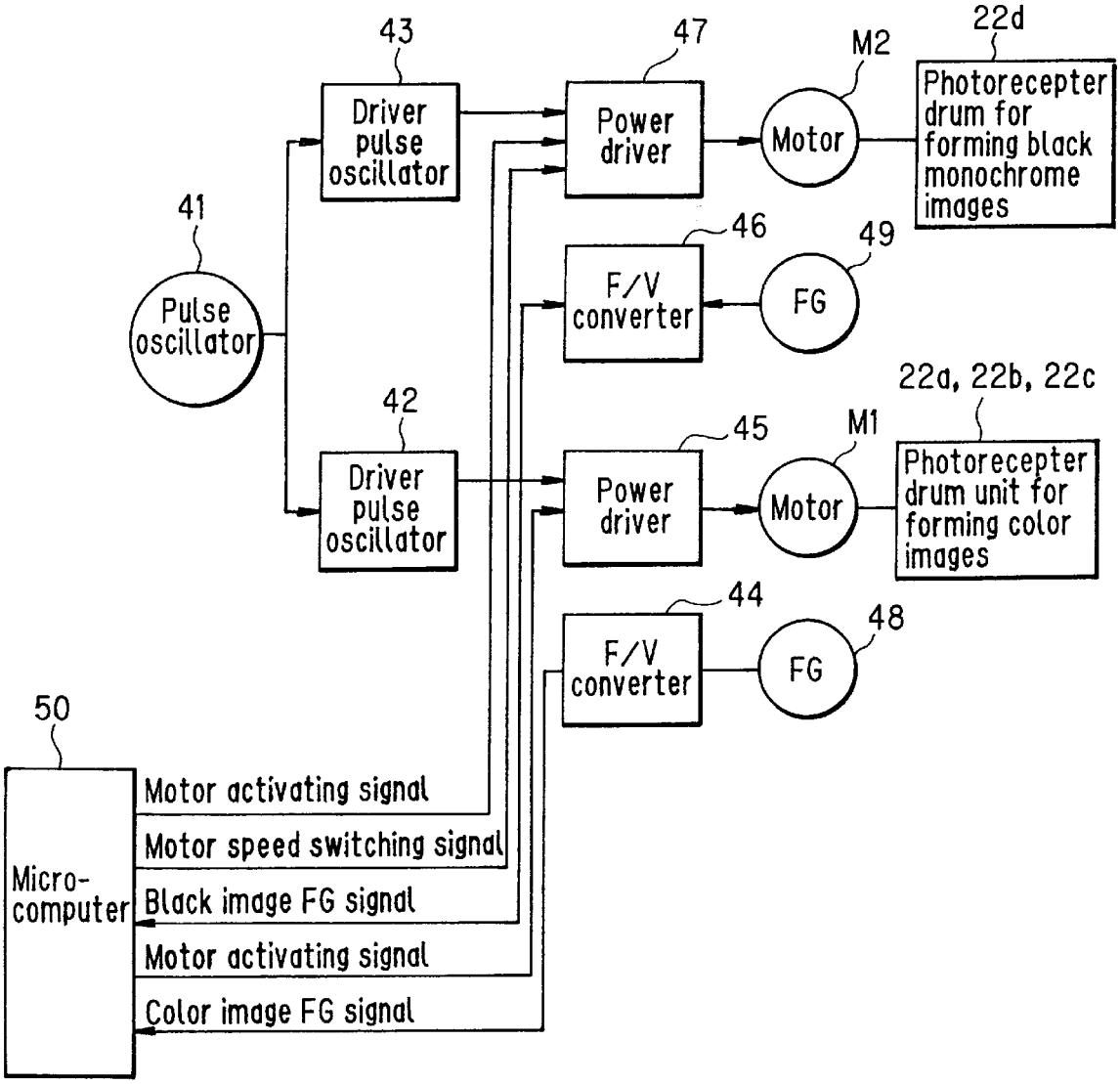
FIG. 3 is a block diagram of the driver circuit of the image forming portion.

Next, the drive control as the essential feature of the invention will be described with reference to FIG. 3. FIG. 3 is a block diagram showing a driver circuit of the image forming portion.

Driver motor M1 for the photoreceptor drums for color image forming and driver motor M2 for the photoreceptor drum for black image forming, are driven based on a single pulse oscillator 41, through driver pulse oscillators 42 and 43 and power drivers 45 and 47. Pulse drivers 45 and 47 receive motor activating signals from a microprocessor 50 so as to control the operations of photoreceptor drums 22*a*, 22*b* and 22*c* for color image forming and the operation of photoreceptor drum 22*d* for black image forming. When motors M1 and M2 are controlled so that they stop and start simultaneously, transfer conveyor belt 16 and photoreceptor drums 22*a*, 22*b*, 22*c* and 22*d* can be stopped and started in synchronization, thus avoiding speed inconsistency of the photoreceptor drums 22*a*, 22*b*, 22*c* and 22*d* against transfer conveyor belt 16 and hence eliminating the wear due to friction therebetween.

Further, the power driver for drive motor M2 of photoreceptor drum 22*d* for black image forming receives a speed selecting signal from the microprocessor so that the motor can switch the driving speed between two levels. The first speed is identical with that of the photoreceptor drums for color image forming. Another speed, i.e., the second speed is set greater than the first speed. Thus, the motor is driven at the first speed in the case of forming color images while it is driven at the second speed in the case of forming black monochrome images only. This configuration provides an increased copy speed during black monochrome image forming.

Figure 4:
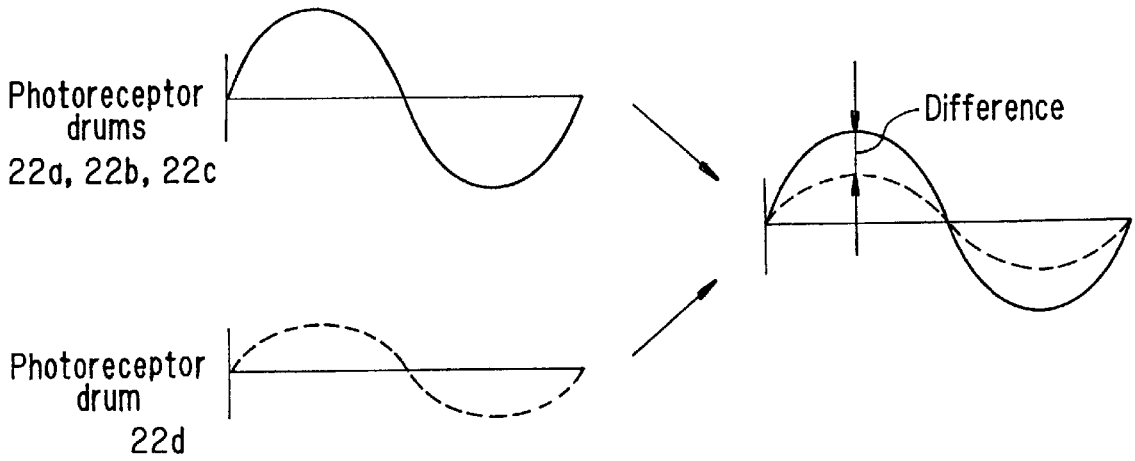
FIG. 4 is an illustrative diagram showing phase synchronization of the rotational speed of the photoreceptor drums.

The variation in the speed of photoreceptor drums 22*a*, 22*b* and 22*c* for color image forming and the variation in the speed of photoreceptor drum 22*d* for black image forming are monitored by microprocessor 50 through FG 48 and FG 49 and F/V converters 44 and 46 to synchronize the former variation with the latter in order to inhibit mis-registration of colors. More specifically, the periodical variation in the rotational speed of photoreceptor drums 22*a*, 22*b* and 22*c* and that of photoreceptor drum 22*d* for black image forming are synchronized with one another as shown in FIG. 4 so that the points at which each speed becomes maximum coincide with each other. That is, the motors are driven with their periodical variations synchronized in phase. In this way, the difference between the variation of the speed of photoreceptor drums 22*a*, 22*b* and 22*c* and that of photoreceptor drum 22*d* is controlled so as to optimize the registration of the formed images.

Figure 5:
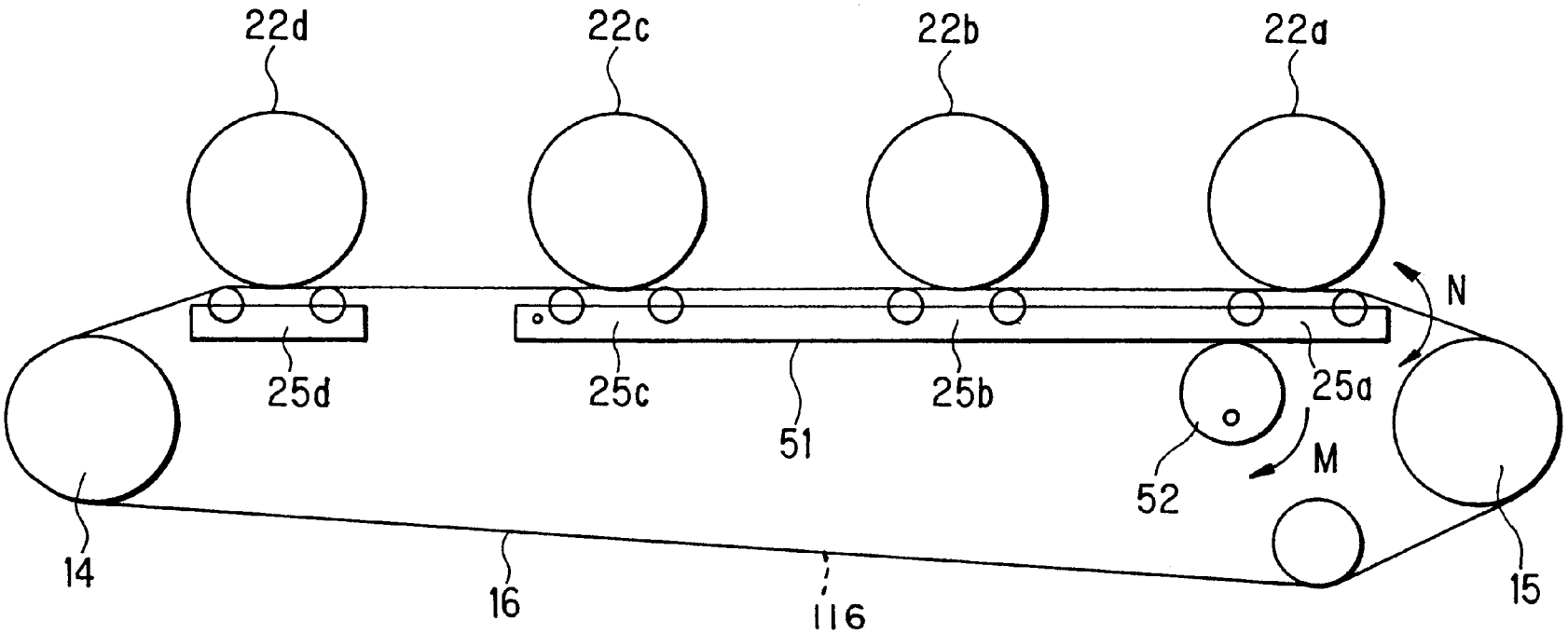
FIG. 5 is an illustrative diagram showing the separation action from the set of photoreceptor drums for forming color images.

Next, the separation action of the set of photoreceptor drums 22*a*, 22*b* and 22*c* for color image forming as part of the essential feature of the invention will be described with reference to FIG. 5. FIG. 5 is an illustrative view for illustrating the separation action of the set of photoreceptor drums for color image forming.

Transfer chargers 25*a*, 25*b* and 25*c* for color image forming are all arranged on a frame 51 which is pivoted at one point on the transfer charger 25*c* side so as to move up and down in the directions shown by bidirectional arrow N when a cam 52 is rotated in the direction of arrow M by means of an unillustrated motor. While color images are formed, frame 51 is in the upper position forming nips between photoreceptor drums 22*a*, 22*b* and 22*c*, and transfer conveyer belt 16, at areas corresponding to respective transfer chargers 25*a*, 25*b* and 25*c*. For black monochrome image forming, the frame 51 is positioned at the lower site, transfer conveyer belt 16 forms clearance with photoreceptor drums 22*a*, 22*b* and 22*c* at areas corresponding to respective transfer chargers 25*a*, 25*b* and 25*c*. In this way, it is possible to prevent the set of photoreceptor drums not related to image forming from touching transfer conveyor belt 16 and staining the transfer conveyer belt 16 surface with toner. Incidentally, transfer conveyor belt 16 may be of an intermediate transfer medium (116). That is, toner images of color separations formed by photoreceptor drums 22*a*, 22*b* and 22*c* may be transferred in a superimposed manner so as to produce a color image on intermediate transfer medium (116), and the thus produced color image may be transferred to the recording medium.

Figure 6:
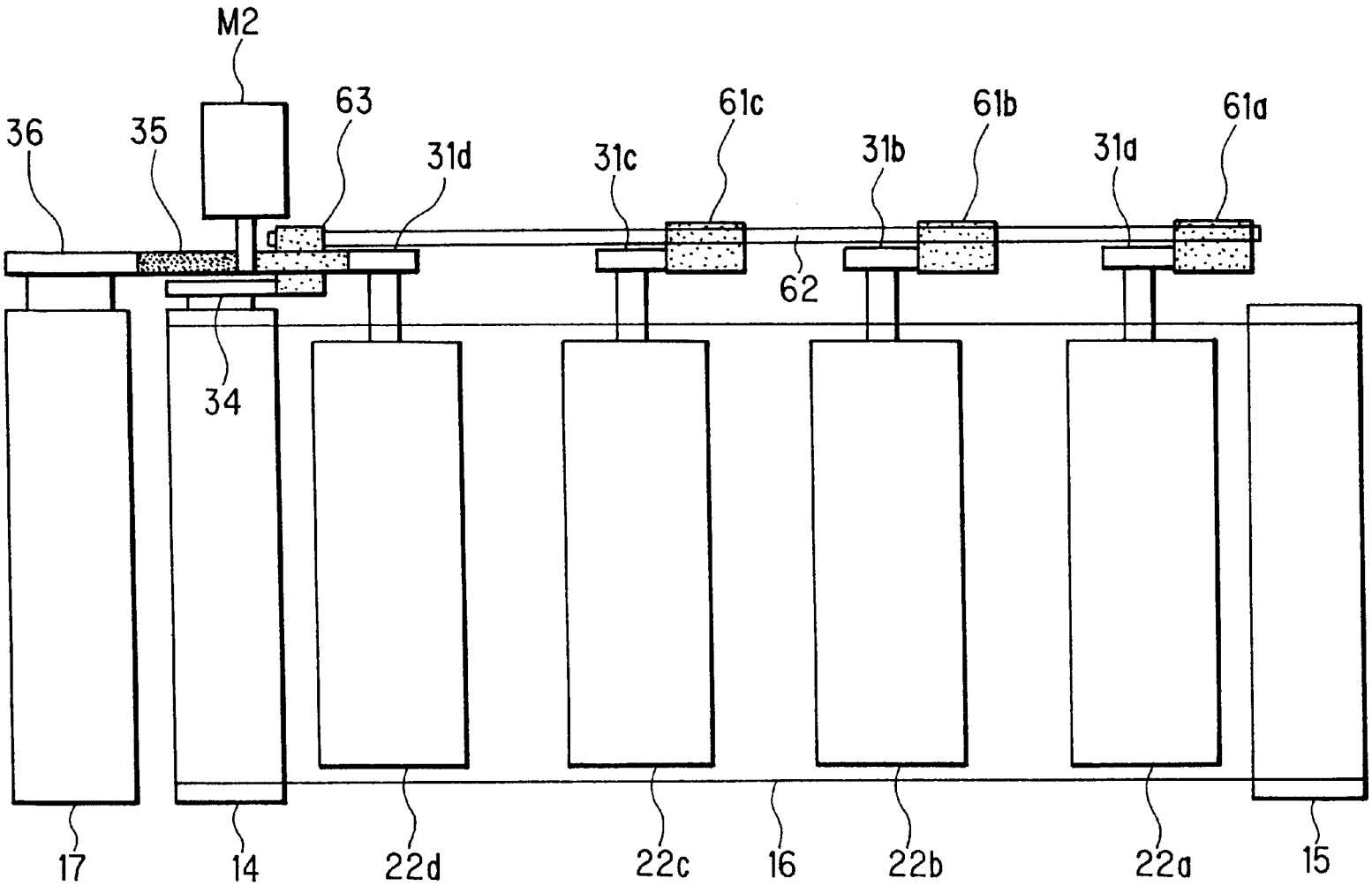
FIG. 6 is an illustrative diagram showing another drive linkage in the image forming portion.

Next, another driving means of the invention will be described with reference to FIG. 6. FIG. 6 is an illustrative diagram showing another drive coupling in image forming portion 10.

Photoreceptor drums 22*a*, 22*b* and 22*c* for forming color images have respective gears 31*a*, 31*b* and 31*c* as the drive transmission elements on their center shafts thereof. The gears are coupled with respective clutches 61*a*, 61*b* and 61*c*, which in turn are coupled with motor M2 through a timing belt 62. Photoreceptor drum 22*d* for forming black monochrome images has a gear 31*d* as the drive transmission element on its central shaft. This gear 31*d* is coupled with motor M2 via a gear 63.

The above drive configuration enables motor M2 to drive both photoreceptor drums 22*a*, 22*b* and 22*c* for color image forming and photoreceptor drum 22*d* for black monochrome image forming. During black monochrome image forming alone, clutches 61*a*, 61*b* and 61*c* may be operated to disengage the driving force to photoreceptor drums 22*a*, 22*b* and 22*c* so that photoreceptor drums 22*a*, 22*b* and 22*c* for color image forming will not be driven unnecessarily. Thus, it is possible to prevent the drums from being frictionally worn out by the cleaning blades.

Further, driving roller 14 of transfer conveyer belt 16 has a gear 34 as the drive transmission element, on the central shaft thereof. This gear 34 is coupled with motor M2 via gear 63. Fixing unit 17 also has a gear 36 on the central shaft of the fixing roller, and this gear is coupled with motor M2 via idle gear 35.

The above drive configuration eliminates the necessity of providing a separate driver source for transfer conveyer belt 16 and fixing unit 17. In this configuration, motor M2 is shared with the driving source of transfer conveyer belt 16 and fixing unit 17. Therefore, when motor M2 is active during image forming, transfer conveyer belt 16 and fixing unit 17 are also automatically active, so that the drive control can be further simplified.

In the above embodiment, a color image is formed on the paper as the recording medium by directly transferring color separated images formed on the different photoreceptor drums. However, the present invention should not be limited to this configuration. For example, transfer conveyer belt 16 may be of an intermediate transfer medium (116). That is, toner images of color separations formed by photoreceptor drums 22*a* 22*b* and 22*c* may be transferred in a superimposed manner so as to produce a color image on intermediate medium (116), and the thus produced color image may be transferred to the recording medium.

In accordance with the first aspect of the invention, the first set of image supports for forming color images and the second image support for forming black monochrome images are driven by individual driving means. Therefore, when black monochrome images are formed, it is not necessary to drive the first set of image supports for forming color images. This configuration prevents unnecessary wear attributed to the contact between the first set of image supports and other components.

In accordance with the second aspect of the invention, since the driving means of the conveyer means for conveying the recording medium is shared with the driving means of the second image support for forming black monochrome images, it is possible to reduce the cost and simplify the drive control.

In accordance with the third aspect of the invention, since the driving means of the intermediate transfer medium is shared with the driving means of the second image support for forming black monochrome images, it is possible to reduce the cost and simplify the drive control.

In accordance with the fourth aspect of the invention, since the driving means of the discharging means for discharging the printed sheet is shared with the driving means of the second image support for forming black monochrome images, it is possible to reduce the cost and simplify the drive control.

In accordance with the fifth aspect of the invention, since the operation of the driving means of the first set of image supports and the operation of the driving means of the second image support are started and stopped simultaneously, each of the image supports will move with the same relative speed to the conveyer means and hence will not be worn by friction.

In accordance with the sixth aspect of the invention, since the first set of image supports for forming color images is separated from the medium to which the image is transferred by the transfer means, it is possible to prevent the first set of image supports for forming color images from touching the recording medium and hence staining the recording medium surface with toner when only black monochrome images are formed.

In accordance with the seventh aspect of the invention, since the driving means of the second image support for forming black monochrome images can be driven at the first speed which is equal to the driving speed of the first sets of image supports for forming color images and at the second speed which is greater than the first speed, it is possible to perform copying operation of black monochrome images at a speed greater than that for forming color images.

In accordance with the eighth and ninth aspects of the invention, since the driving means of the first set of image supports for forming color images and the driving means of the second image support for forming black monochrome images are operated with their periodical drive variations synchronized in phase, it is possible to inhibit misregistration of color images with the black monochrome image.

What is claimed is:

1. An image forming apparatus comprising:

a plurality of image supports, said plurality of image supports including a first set of image supports adapted to have color separated images formed thereon and a second image support adapted to have a black monochrome image formed thereon;

latent image forming means for forming a latent image on each of said image supports;

developing means for visualizing the latent images formed on said image supports;

transfer means for successively transferring the visualized images formed on said image supports onto a recording medium to form an image thereon;

conveying means for conveying said recording medium to said transfer means;

driving means for driving said conveying means and rotationally driving said second image support, and, when a full color image is desired, for selectively rotationally driving the image supports of said first set of image supports, said driving means comprising a first independent drive device for rotationally driving said second image support and said conveying means, and a second independent drive device for rotationally driving each of the image supports of said first set of image supports; and discharging means for discharging said recording medium with an image transferred thereon.

2. The image forming apparatus according to claim 1, wherein said transfer means temporarily transfers said visualized images formed on said image supports onto an intermediate transfer medium so as to produce an image thereon and then transfers said image to said recording medium, and wherein the driving means that drives said second image support also drives said intermediate transfer medium.

3. The image forming apparatus according to claim 1, wherein said driving means comprises a first independent drive device that drives said second image support, and also drives both said conveying means and said discharge means.

4. The image forming apparatus according to claim 1, wherein the operation of said driving means is started and stopped such that the image supports of said first set of image supports and said second image support are started and stopped simultaneously.

5. The image forming apparatus according to claim 1, wherein said first set of image supports is adapted to be separated from said recording medium to which the image is transferred by said transfer means and said driving means is adapted to rotate only said second image support and said conveying means when said first set of image supports is separated from said recording medium.

6. The image forming apparatus according to claim 1, wherein said driving means is adapted to be operated in such a way that said first set of image supports is operated at a first speed and such that said second image support can be operated at said first speed and at a second speed, said first speed being slower than said second speed.

7. An image forming apparatus according to claim 1, wherein said first drive device and said second drive device are operated with their respective periodical drive variations synchronized in phase with each other;

wherein said first drive device and said second drive device each comprise a motor including a detecting means for detecting motor speed, and wherein said driving means also includes synchronization means for synchronizing the speeds of said motors with one another.

8. An image forming apparatus according to claim 1, wherein said apparatus is adapted to successively transfer color images to said recording medium.

9. An image forming apparatus according to claim 1, wherein said apparatus is adapted to successively transfer black monochrome images to said recording medium.

10. An image forming apparatus according to claim 1, wherein said apparatus is adapted to successively transfer color images and black monochrome images to said recording medium in any desired sequence.

11. An image forming apparatus according to claim 2, wherein said image is a color image, and said color image is produced on said intermediate medium in a superimposed manner.

* * * * *

UNITED STATES PATENT AND TRADEMARK OFFICE

CERTIFICATE OF CORRECTION

PATENT NO. : 6,173,141 B1
DATED : January 9, 2001
INVENTOR(S) : Hidekazu Sakagami, Toshiro Kurishita, Masashi Hirai and Osamu Nakayama It is certified that error appears in the above-identified patent and that said Letters Patent is hereby corrected as shown below:

Title page,
In the Foreign Application Priority Data section, please change "July 19, 1997" to -- July 1, 1997 --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*